United States Patent [19]

Beasley

[11] 4,193,359

[45] Mar. 18, 1980

[54] LOW PILE FORMING APPARATUS FOR TUFTING MACHINE

[75] Inventor: Max M. Beasley, Chattanooga, Tenn.

[73] Assignee: Tuftco Corporation, Chattanooga, Tenn.

[21] Appl. No.: 918,482

[22] Filed: Jun. 23, 1978

[51] Int. Cl.[2] ..... D05C 15/00

[52] U.S. Cl. ..... 112/79 R

[58] Field of Search ..... 112/79 R, 79 A, 79.5

[56] References Cited

U.S. PATENT DOCUMENTS

| | | | |
|---|---|---|---|
| 3,019,748 | 2/1962 | Card | 112/79 R |
| 3,216,382 | 11/1965 | Wittler | 112/79 R |
| 3,585,948 | 6/1971 | Cobble | 112/79 R |
| 3,780,678 | 12/1973 | Short | 112/79 A |
| 3,880,101 | 4/1975 | Passons | 112/79 R |
| 3,973,505 | 8/1976 | Prichard | 112/79 R |

*Primary Examiner*—Ronald Feldbaum

*Attorney, Agent, or Firm*—Harrington A. Lackey

[57] ABSTRACT

A tufting machine for forming low pile in a base fabric, in which the bills of the loopers are arranged at substantially the same level as the needle plate fingers.

4 Claims, 3 Drawing Figures

LOW PILE FORMING APPARATUS FOR TUFTING MACHINE

BACKGROUND OF THE INVENTION

This invention relates to a tufting machine, and more particularly to a tufting machine for forming low pile.

In conventional multiple-needle tufting machines, the entire looper apparatus is located beneath the needle plate fingers. In a cut pile machine, the height of the pile loops is determined by the depth of the looper cutting edge below the base fabric. Normally this is adjusted by varying the distance from the top of the needle plate to the looper cutting edge by adjusting the height of the needle plate relative to the loopers.

In the trend in the tufting industry toward finer gauges, more yarn loops are concentrated per unit area of the tufted fabric, thus increasing the density of the yarn. Moreover, the pile weight is increased with the height of the pile yarn. Therefore, in order to produce a denser, longer wearing tufted fabric, without unduly increasing pile weight, it is necessary to use finger gauges and lower pile height. In the past, minimum pile heights have been limited by interference between loopers and needle plate fingers.

SUMMARY OF THE INVENTION

It is therefore an object of this invention to provide a multiple-needle tufting machine for producing tufted fabrics of minimum pile height, for particular utility in narrow-gauge tufting machines.

The minimum pile height is attained in a tufting machine made in accordance with this invention by arranging the hook bills so that they are disposed substantially at the same level or substantially in the same horizontal plane as the needle plate fingers. In most instances, the needle plate fingers must be re-arranged slightly from their normal disposition, so that the hook bills, the needle plate fingers, and the needles, as well as the knives in cut pile apparatus, have sufficient clearance to operate successfully, particularly within the parameters of a narrow gauge machine.

By locating the hook bills at substantially the same level as the needle plate fingers, the tops of the bills are disposed substantially coplanar with the tops of the needle plate fingers, so that the bills and the needle plate fingers together support the base fabric as it moves through the tufting machine. Thus, the pile height is limited only by the height or vertical dimension, of the bill of each looper.

DESCRIPTION OF THE PREFERRED EMBODIMENTS

Figure 1:
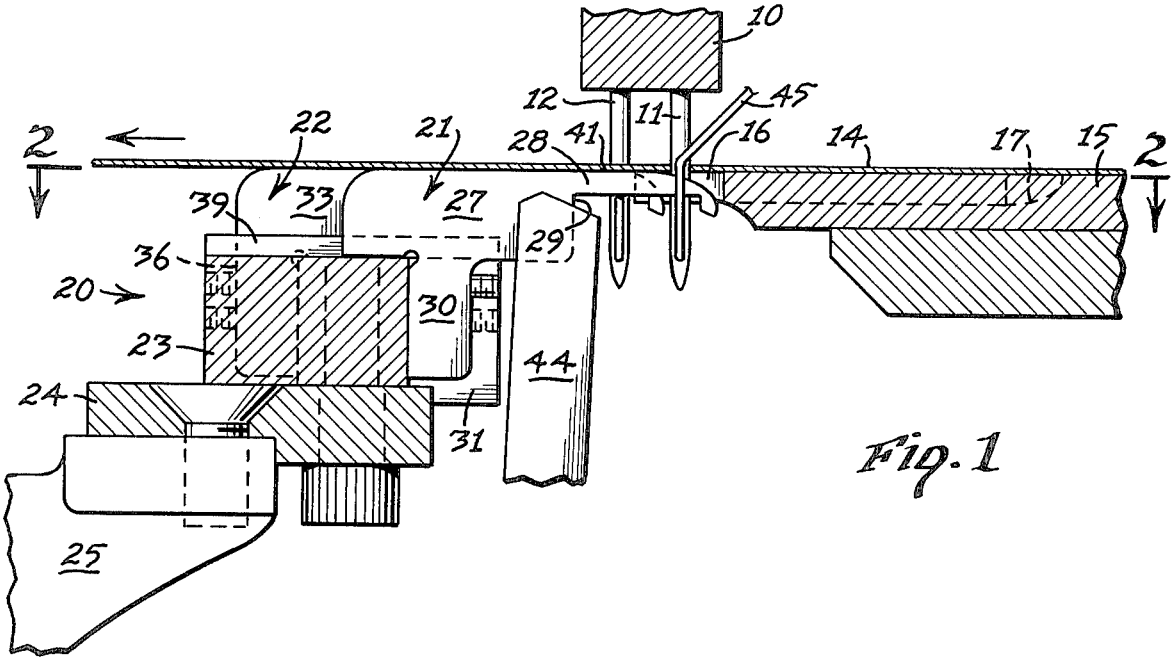
FIG. 1 is a fragmentary, sectional elevation of a cut pile tufting machine made in accordance with this invention, in which the loopers and needles are in a loop-forming position.

Referring now to the drawings in more detail, FIG. 1 discloses a portion of a transverse needle bar 10 in a conventional staggered multiple-needle tufting machine, supporting a first row of uniformly spaced front needles 11 and a second row of uniformly spaced rear needles 12 offset preferably midway between the front needles 11, to provide a uniform, narrow needle gauge.

Adapted to move from front-to-rear through the tufting machine in the direction of the arrow, is a base fabric 14 supported upon a needle plate 15 for penetration by the vertically reciprocable needles 11 and 12.

Figure 2:
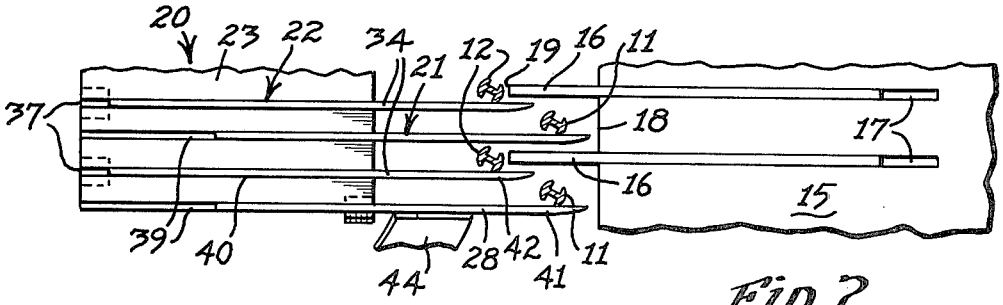
FIG. 2 is a section taken along the line 2—2 of FIG. 1.

In a tufting machine made in accordance with this invention, the needle plate fingers 16 are arranged in corresponding needle plate finger slots 17, slightly differently from a conventional needle plate. In this apparatus, there are only half as many needle plate fingers 16, which are uniformly spaced on a double needle gauge. As best disclosed in FIG. 2, each needle plate finger 16 projects rearward from the rear edge 18 of the needle plate 15 substantially equidistant between the front needles 11 and in substantial longitudinal alignment with the path of a corresponding rear needle 12. However the free or rear end 19 of each needle plate finger 16 terminates a short distance from the path of the corresponding rear needle 12, so that when the corresponding rear needle 12 penetrates the base fabric 14 and descends below the level of the needle plate 16, the needle plate finger 16 will offer no obstruction to the movement of the corresponding rear needle 12.

The looper apparatus 20 includes a plurality of transversely aligned front loopers 21 and a plurality of transversely aligned rear loopers 22 mounted upon a transversely extending hook bar 23. The hook bar 23 is fixed to a mounting plate 24, which in turn is supported by a plurality of transversely spaced rocker arms 25 mounted on a rocker shaft; not shown, in a conventional manner for reciprocal movement of the hook bar 23 and the loopers 21 and 22.

Although the particular construction of the loopers 21 and 22 and the hook bar 23 are not essential to the functioning of this invention, nevertheless the loopers 21 and 22 are made quite thin and spaced closely together in staggered relationship in order to provide a very narrow gauge.

Front looper 21 includes a body portion 27 having a bill 28 projecting from the body portion 27 and defining a throat portion 29. Depending from the body portion 27 is a shank 30 received in a front slot 31 within the hook bar 23.

In a similar manner, the rear looper 22 includes a body portion 33 having a forward projecting bill 34 and a throat portion, not shown, in transverse alignment with the throat portions 29 of the loopers 22. Each rear looper 22 is provided with a depending shank portion 36 received within a corresponding rear slot 37.

The body portions 27 and 33 of the respective loopers 21 and 22, because of their thinness, are futher stabilized and supported by being received in corresponding longitudinal top slots 39 and 40, respectively.

As best disclosed in FIG. 1, the loopers 21 and 22 are located in positions substantially elevated from conventional loopers. In particular, the top edges 41 and 42 of the bills 28 and 34 are located generally at the same level, or in substantially the same horizontal plane, as the top edges of the needle plate fingers 16, when the loopers 21 and 22 are in their forward, loop-forming positions. Thus, the bottom surface of the base fabric 14, as it moves from front-to-rear through the tufting machine, is supported not only by the needle plate 15 and the tops of the needle fingers 16, but also by the top edges 41 and 42 of the looper bills 28 and 34, respectively.

Cooperating with each of the loopers 21 and 22 in the vicinity of the throat portions 29 and their intersections with their respective bills 28 and 34, are a plurality of transversely aligned knives 44. The knives 44 are reciprocated between their inoperative, non-cutting positions, disclosed in FIG. 1 and their operative cutting positions, not shown, in a conventional manner.

Since the needles 11 and 12 are staggered, and the throat portions 29 and knives 44 are transversely aligned, all of the front bills 28 are longer than the rear bills 34, so that the bills 28 and 34 cross their corresponding front needles 11 and rear needles 12 by substantially the same amount, as disclosed in all of the drawings. Such an arrangement of staggered needles and corresponding alternating long and short bills for loopers having transversely aligned throat portions and knives are clearly disclosed in the prior Card U.S. Pat. No. 4,003,321.

It is therefore apparent, particularly from FIG. 1, that as each looper bill, such as the looper bill 28, crosses its corresponding front needle 11, in its lower position to catch a yarn 45 to form a loop, that the depth of the loop, or pile height, will substantially equal the height of the corresponding bill 28, since the top edge 41 of the bill is normally flush against the bottom surface of the base fabric 14.

Figure 3:
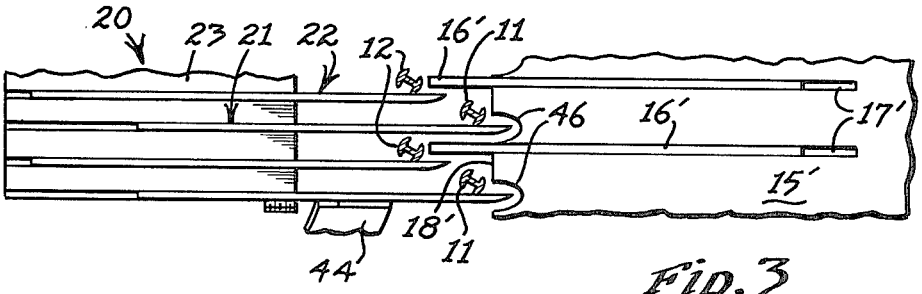
FIG. 3 is a fragmentary section similar to FIG. 2, but disclosing a slightly modified form of the needle plate.

FIG. 3 discloses a modified form of the apparatus in which the rear edge 18' of the needle plate 15' extends farther rearwardly than the corresponding rear edge 18, so that the rear edge 18' is located closer the front needles 11. Thus, the needle plate fingers 16' do not project as far from the rear edge 18' as the needle plate fingers 16 do from their corresponding rear edge 18, thereby giving greater support to the base fabric 14 moving through the machine. In such event, looper recesses 46 are formed in the rear edge 18' at uniformly spaced intervals so that the recesses 46 are each in longitudinal alignment with a corresponding front looper 21. Accordingly, the extremity of each front bill 28 is received in a corresponding recess 46 to prevent the needle plate 15' from obstructing the movement of the front looper bills 28.

Since the pile height is not limited by the height of the needle plate fingers 16, the needle plate fingers 16 may have greater depth, in order to be stronger, particularly since they are spaced on a double gauge.

Moreover, the height of each looper bill 28 and 34 may be greater than the corresponding height of conventional loopers at lower elevations. In a conventional tufting machine, a bill of a looper at a lower elevation is sometimes reduced in height in order to reduce the pile height. However, when the height of the looper was reduced too greatly, the strength of the looper bill was in jeopardy because of the reduction in vertical thickness. By the same token, the loopers 21 and 22 at a higher level than conventional loopers can have bills 28 and 34 of greater vertical thickness than conventional looper bills at lower levels, to form lower pile heights.

Thus, tufting apparatus made in accordance with this invention permits stronger loopers and looper bills as well as needle plate fingers, even for very fine needle gauges, in the order of 1/16th inch.

Moreover, in a conventional tufting machine, even where the height of the looper bills is reduced, about the minimum pile height available is approximately ¼ inch. In apparatus made in accordance with this invention experimentally, pile heights as low as 3/32 inch have been successfully obtained.

What is claimed is:

1. In a staggered needle tufting machine having means for supporting the base fabric for longitudinal movement in the feeding direction through said machine, a first row of transversely spaced reciprocal front needles for introducing yarns through the base fabric to form front loops, a second row of transversely spaced reciprocal rear needles, spaced longitudinally behind, and uniformly staggered relative to, said first row of needles for introducing yarns through the base fabric to form rear loops, a low-pile tufting apparatus comprising:

(a) a needle plate having a plurality of needle plate fingers projecting rearward, each needle plate finger having a top surface, (b) each of said needle plate fingers being in substantial longitudinal alignment with the reciprocal path of a corresponding rear needle, each of said needle plate fingers terminating adjacent to and slightly spaced in front of said corresponding rear needle path, (c) a looper apparatus including a looper for each needle having a bill adapted to cooperate with a corresponding needle to form pile loops in operative position, each bill having a top surface, and (d) means supporting said looper apparatus for reciprocable movement so that each looper bill cooperates with a corresponding needle, and the top surface of said looper bills are coplanar with the top surfaces of said needle plate fingers to support the base fabric upon the top surfaces of the loopers and the needle plate fingers when said loopers are in operative position and as the base fabric moves longitudinally in the feeding direction through the machine.

2. The invention according to claim 6 in which said loopers comprise a first set of front loopers and a second set of rear loopers, said front needles being adapted to reciprocate between said needle plate fingers, the bills of said front loopers projecting forward between the needle plate fingers to cooperate with said front needles.

3. The invention according to claim 2 in which said first and second sets of loopers have transversely aligned throat portions, and further comprising a plurality of transversely aligned knives, there being one knife for each looper cooperating with the throat portion of said corresponding looper.

4. The invention according to claim 2 in which said needle plate has a rear face from which said needle plate fingers project rearwardly, a plurality of recesses in said rear face, there being a recess between each of said needle plate fingers in longitudinal alignment with a corresponding looper bill of said second set, each recess being adapted to receive the extremity of the bill in said second set, in operative position.

* * * * *